United States Patent [19]

Ortiz

[11] 4,040,698

[45] Aug. 9, 1977

[54] ELECTRICAL SAFETY OUTLET AND PLUG

[75] Inventor: Nilson V. Ortiz, San Francisco, Calif.

[73] Assignees: Nilson V. Ortiz; Francisco R. Rollojay, both of San Francisco, Calif.

[21] Appl. No.: 731,603

[22] Filed: Oct. 12, 1976

[51] Int. Cl.[2] ..... H01R 13/44; H01R 13/54

[52] U.S. Cl. ..... 339/75 P; 339/39; 339/40

[58] Field of Search ..... 339/14 P, 36, 39, 40, 339/42, 75 P, 91 R, 176 P, 186 R, 186 M

[56] References Cited

U.S. PATENT DOCUMENTS

| | | | |
|---|---|---|---|
| 2,820,842 | 1/1958 | Meistrell | 339/40 X |
| 3,865,456 | 2/1975 | Dola | 339/40 |

FOREIGN PATENT DOCUMENTS

| | | | |
|---|---|---|---|
| 449,631 | 7/1936 | United Kingdom | 339/40 |

*Primary Examiner*—Roy Lake
*Assistant Examiner*—E. F. Desmond
*Attorney, Agent, or Firm*—Robert K. Rhea

[57] ABSTRACT

A wall mounted electric outlet, including an elongated box-like casing having a plurality of longitudinal slots in its front wall, slidably receiving the conductor and locking prongs of an electric plug, when inserted into the casing through a transverse slot formed in one end portion of the front wall in communication with the longitudinal slots. The transverse slot being normally closed by a plunger movable inwardly of the front wall for inserting the plug prongs into the slots. The casing contains a pair of conductor strips contacted by the conductor prongs of the plug.

5 Claims, 8 Drawing Figures

ELECTRICAL SAFETY OUTLET AND PLUG

BACKGROUND OF THE INVENTION

1. FIELD OF THE INVENTION

The present invention relates to electric outlets and more particularly to an electric outlet having elongated conductor strips slidably receiving angular-shaped prongs of an electric cord plug in locking relation.

As is well known, wall mounted electric outlets are adapted for insertion and withdrawal of the conductor prongs of a plug forming a part of or attached to an electric cord. The outlets are often within easy reach of small children who have a tendency to pull on the electric cord thus interrupting current to an appliance, or the like. Further, children, when playing, often insert metallic objects into the slots of an electric outlet, commonly known as a socket, thus causing a short circuit, throwing a breaker switch or blowing a fuse as well as the danger of receiving an electrical shock.

It is, therefore, desirable to provide some safeguard to prevent unauthorized current interruption and minimize the danger of electrical shock.

2. DESCRIPTION OF THE PRIOR ART

Prior patents featuring safety electric outlets have generally comprised attachments for the faceplate of an electric outlet featuring rotatable snap-on or sliding covers for the electric socket opening, such as disclosed by U.S. Pat. Nos. 3,639,886 and 3,656,083 in which the face plate attachments are manually moved for insertion and removal of the plug. Other patents, such as U.S. Pat. Nos. 2,552,061 and 2,610,999 feature overlying slotted slidable plates which must be manually moved to mate the overlying plate slots with the electric outlet slots or openings for insertion and removal of the plug. One disadvantage of a manually movable face plate is that a small child, by observation, may learn to expose the electric outlet socket and thus create a potential hazard to himself.

This invention features an electric outlet in which the conductors or contacts are disposed in off-set relation with respect to plug prong receiving slots thus preventing electrical conductive contact with objects inserted into the electric outlet through its plug prong receiving slots while simultaneoulsy preventing separation of the plug from the outlet by a pull on the cordattached to the plug.

SUMMARY OF THE INVENTION

A box-like casing or receptacle adapted to be secured to a wall, or the like, contains a pair of elongated electrical conductor strips disposed in off-set relation with respect to elongated plug prong receiving slots formed in its front wall. The longitudinal slots communicate at one end with a transverse slot normally closed by a spring urgedplunger which must be manually forced inwardly for inserting plug prongs into the slots to contact the strip conductors. The plug prongs, each having at least one angular bend intermediate its length for engaging the respective conductor strip surface opposite the casing front wall.

The principal object of this invention is to provide an electrical outlet and a cooperating electric cord plug which is substantially tamper proof and which lockably secures the plug to the outlet when inserted thereinto.

DESCRIPTION OF THE PREFERRED EMBODIMENTS

Figure 1:
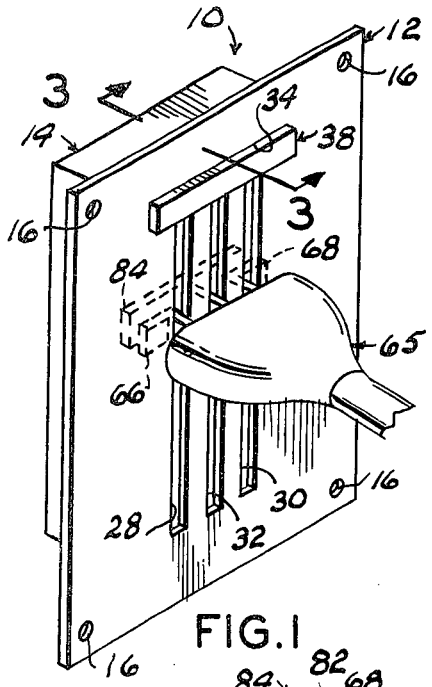
FIG. 1 is a perspective view of an electric outlet having an electrical plug connected therewith, the plug prongs being shown by dotted lines.

Like characters of reference designate like parts in those figures of the drawings in which they occur.

In the drawings:

The reference numeral 10 indicates an electrical outlet or receptacle, as a whole, preferably formed from nonconductive metallic material or plastic, comprising a face plate 12 and a box-like housing or casing 14. The face plate 12 is planar and is provided with a plurality of apertures 16 for receiving screws, not shown, and connecting the face plate to a wall, or the like, not shown. The casing 14 includes a back wall 18 joined in spaced relation to the central rearward surface 20 of the face plate by end walls 22 and 24 and side walls 26. The face plate 12 is provided with a pair of longitudinal slots 28 and 30 disposed in parallel spaced relation in the central portion of the face plate 12. A third intermediate face plate slot 32 is centrally disposed between the pair of slots 28 and 30 and is coextensive therewith. The width of the slots 28, 30 and 32 is relativelynarrow when compared with their length and the spacing between the slots is greater than the width of any one of the slots for the reasons presently apparent. Each of the slots 28, 30 and 32 communicate with a rectangular slot 34 transversely formed in the face plate 12 adjacent the inward surface of the casing end wall 22. The length of the slot 34 is preferably slightly greater than the spacing between the pair of slots 28 and 30 and the transverse width of the slot 34 is slightly greater than the transverse width of conductor plug prongs to be presently described.

A horizontal partition 36 extends between the casing back wall 18 and rearward surface 20 of the face plate and between the casing side walls 26 to form a chamber 37 slidably receiving a plunger 38 and normally closing the horizontal slot 34. The plunger 38 is rectangular in general configuration having opposing surfaces 40 and 42 slidably contacting adjacent surfaces of the casing end wall 22 and partition wall 36. A reduced forwardly disposed portion 44 of the plunger 38 normally projects a short distance through the horizontalslot 34.

Resilient members, such as helical springs 46, only one being shown, are interposed between the inward surface of the casing back wall 18 and a like number of sockets 48 formed in the rearward surface of the plunger 38 to normally bias the plunger into its slot closing position.

A pair of elongated strap metal-like conductors 50 and 52 are longitudinally disposed within the casing 14 laterally of the respective slot of the pair of slots 28 and 30. Since each of the conductor strips 50 and 52 are identical, only the strip 50 is described in detail. The conductor 50 comprises a base member 54 transversely supported by the inner surface of the casing bottom wall 24 and substantially coextensive therewith. One end of the base member 54 is integrally joined to a forward member 56 contiguously contacting the rearward surface 20 of the face plate adjacent the slot 30 and terminating adjacent the depending limit of the transverse slot 34. A similar reareard member 58, integrally joinedat its depending end, as viewed in the drawings, to the base member 54 in parallel rearwardly spaced relation with respect to the forward member 56, terminates equidistant with the forward member 56. The other end of the base member 54 is provided with an upstanding end portion, as viewed in the drawings, forming a lug 60 having a threaded aperture cooperatively receiving a conductorscrew 62 extending through the casing back wall 18 for connection with a source of electrical energy, not shown. The other conductor strip 52 is similarly disposed adjacent the longitudinal slot 28.

The reference numeral 65 indicates a conductor plug of substantially conventional construction with the exception of its L-shaped conductor prongs 66 and 68. The conductor prongs 66 and 68 are formed of strap-like material, each having a leg portion 70 and 72, respectively, imbedded at one end portion within the plug body 74 in parallel spaced relation and connectedwith wires 76 and 78. The spacing between the prong leg portions 70 and 72 is such that they are freely received slidably by the pair of face plate slots 28 and 30. The length of the respective prong leg portion 70 and 72 is at least as great as the combined thickness of the face plate 12 and respective conductor strip forward member 56. Each conductor prong 66 and 68 terminates in a foot portion 80 and 82, respectively, disposed in rightangular relation with respect to the respective leg portion for longitudinal sliding contact between the respective forward and rearward conductor strip members 56 and 58. The length of each conductor prong foot portion 80 and 82 is substantially equal to the transverse width of the conductor strip members 56 and 58.

The plug 65 further includes a T-shaped prong 84 formed of strap-like nonconductive material having one end of its stem portion 86 similarly imbedded in or secured to the plug body 74 medially the spacing between the conductor leg prongs 70 and 72 for cooperative reception by the face plate intermediate slot 32. The length of the stem portion 86, projecting beyond the plug body 74, is at least as great as the combined distance between the forward surface of the face plate 12 and the rearward surface of the conductor strip rearward member 58. The T-shaped prong further includes a head bar 88 disposed in parallel spaced relationwith respect to the conductor prong foot portions 80 and 82 and is spaced therefrom a distance at least equal to the thickness of the respective rearward member 58. The length of the head bar 88 is substantially coextensive with the spacing between the lateral endlimits of the conductor prong foot portions 80 and 82. The purpose of the T-shaped prong 84 is to insure electrical conductive contact between the plug conductor prongs 66 and 68 and the respective conductor strip members 56 and 58 and to prevent removal of the plug from the outlet 10 by a force exerted on the plug 65 in a direction substantially normal to the plane of the face plate.

Figure 3:
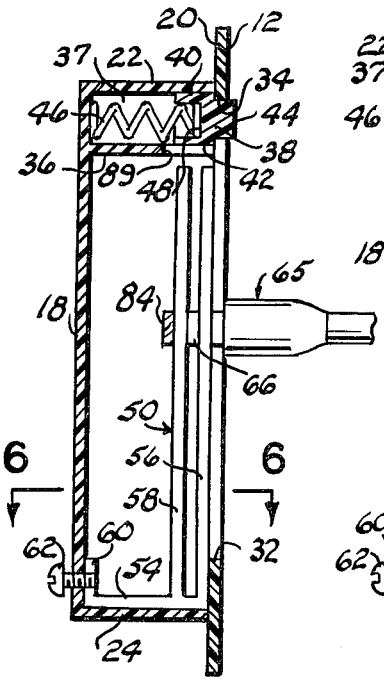
FIG. 3 is a vertical cross sectional view taken substantially along the line 3—3 of FIG. 1.

The conductor plug 65, when connected with the outlet 10, is normally in a position, such as is illustrated by FIGS. 1 and 3. The prongs of the plug 65 are inserted into the outlet slots 28–30 and 32 by manually positioning the bar 88 of the T-shaped prong in contiguous contact with the reduced portion 44 of the plunger 38 projecting forwardly through the transverse slot 34 and manually pushing the plunger 38 inwardly to substantially the position shown by FIG. 4. The prongs 66, 68 and 84 are then in vertical spaced cooperative alignment with the respective conductor strip members 56 and 58 and slots 28–30 and 32 through a recess 89 in the partition thus permitting the plug 65 to be moved downward to its dotted line position. The plug prong foot portions 80 and 82 are respectively received in sliding relation between the conductor strip members 56 and 58 and the T-shaped prong bar 88 is disposed rearwardly of the rearward surface of the conductor strip member 58. Simultaneously with this action the springs 46 bias the plunger 38 forwardly to close the transverse slot 34. The mass of the plug 65 and wiring 76 and 78, connected therewith, normally tends to tilt the wire connected end of the plug downwardly, as viewed in the drawings, tending to bias the conductor strip rearward member 58 rearwardly of the conductor strip forward member 56. This action is prevented by the T-bar 88 contacting the rearward surface of the conductor strip rearward member 88.

Figure 7:
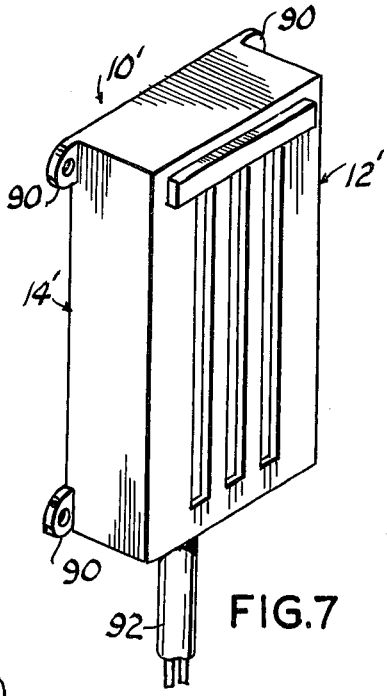
FIG. 7 is a view similar to FIG. 1 illustrating an alternative embodiment of the electric outlet; and, FIG. 8 is a perspective view of an adaptor plug for use with the electric outlets of FIGS. 1 and 6.

FIG. 7 illustrates an alternative embodiment of the outlet 10, indicated at 10′, which basically comprises an identical casing 14′ having a similar longitudinally slotted face plate 12′ but eliminating the marginal edge portions of the face plate projecting beyond the side and end limits of the casing 14. The casing 14′ is provided with a plurality of apertured lugs 90 for connecting the outlet 10′ to any suitable supporting surface. Wiring 92 is connected with the conductor strips within the housing 14′ in a substantially conventional manner.

Figure 8:
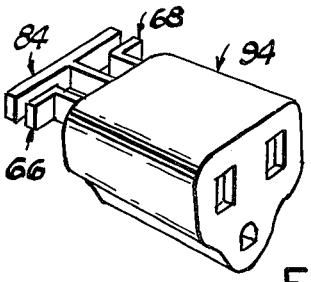

FIG. 8 illustrates an adaptor plug 94 of substantially conventional construction modified to include the L-shaped conductor prongs 66 and 68 and T-shaped prong 84, as described hereinabove, for connecting a conventional three-prong grounded-type conductor plug, not shown, to either of the outlets 10 and 10′.

OPERATION

In operation, one of the plugs 65 is connected with the outlet 10 or 10′ by manually forcing the plunger 38 inwardly and sliding the plug prongs 66, 68 and 84 downwardly, as described hereinabove, thus preventing small children, or the like, from removing the plug from the outlet by a pull on the cord. The elongatedslots and conductor strips permit a plurality of the plugs 65 or adaptors 94 to be connected with each outlet.

Figure 4:
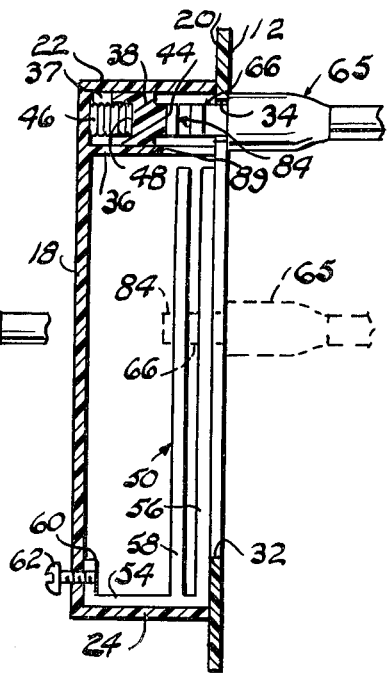
FIG. 4 is a view similar to FIG. 3 illustrating, by solid and dotted lines, the manner of inserting the electrical plug into the outlet.
Figure 2:
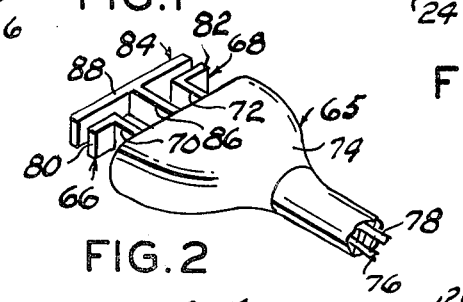
FIG. 2 is a fragmentary perspective view of an electrical plug.
Figure 5:
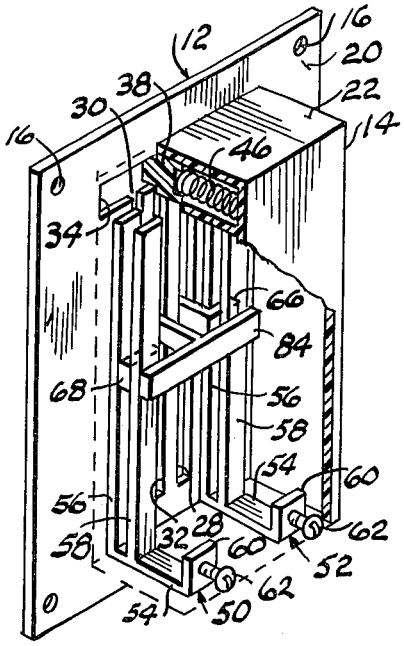
FIG. 5 is a perspective view of the opposite side of the electric outlet shown by FIG. 1, with parts broken away for clarity and illustrating the relative position of the plug prongs.
Figure 6:
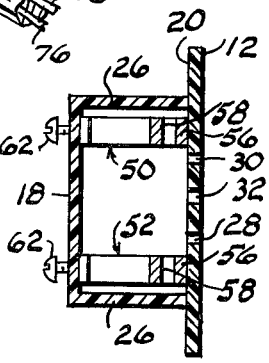
FIG. 6 is a horizontal sectional view taken substantially along the line 6—6 of FIG. 3.

The plug is removed from the receptacle by manually forcing the plunger 38 inwardly to substantially its position shown by FIG. 4 while simultaneously lifting the plug into alignment with the transverse slot 34 to remove the plug prongs. The adaptor plug 94 has its prongs 66, 68 and 84 connected with or removed from the outlet in an identical manner to that described for the plug 65.

Obviously the invention is susceptible to changes or alteractions without defeating its practicability. Therefore, I do not wish to be confined to the preferred embodiment shown in the drawings and described herein.

I claim:

1. An electrical safety outlet and plug, comprising:

an elongated casing having a back wall and a face plate;

a pair of longitudinally extending spaced conductor strips within said casing, each said conductor strip comprising a forward member disposed adjacent said face plate and a rearward member parallel with said forward member and spaced toward said casing back wall, said face plate having a pair of spaced longitudinal slots aligned with said conductor strips for longitudinally slidably receiving the conductor prongs of an electric plug, said face plate having an intermediate longitudinal slot disposed between the pair of slots and having a transverse slot in one end portion communicating with the pair of slots and the intermediate slot;

an electric plug having a body portion enclosing one end portion of a pair of conductor wires;

a pair of conductor prongs secured at one end portion to the respective said wires within said plug body in parallel equally spaced relation with repsect to said pair of face plate slots, the other end portion of each conductor prong projecting laterally of its said one end portion in the planes of the parallel end portions;

a nonconductor prong slidably received by the face plate intermediate slot and secured at one end portion within said plug body between said pair of conductor prongs and having an opposite end portion projecting laterally of its first said one end portion parallel to the plane of said conductor prongs other end portions; and, plunger means normally closing the face plate transverse slot.

2. An electrical outlet and plug according to claim 1 in which said plunger means comprises:

a plunger coextensive with the transverse slot and having a reduced portion nested by the transverse slot; and, at least one resilient member interposed between said plunger and said casing back wall.

3. An electrical outlet and plug according to claim 2 and further including:

a partition transversely dividing said casing adjacent the transverse slot and forming a chamber enclosing said plunger and said resilient member, said partition having a recess providing communication between the chamber and the casing interior.

4. An electrical outlet and plug according to claim 3 in which said conductor plug prongs are L-shaped and having the foot portion of the L-shapes projecting in opposing directions.

5. An electrical outlet and plug according to claim 4 in which said nonconductor plug prong is T-shaped and having the bar of its T-shape parallel with and coextensive with the foot portions of said L-shaped prongs.

* * * * *